US011648564B2

(12) United States Patent
Sim et al.

(10) Patent No.: US 11,648,564 B2
(45) Date of Patent: May 16, 2023

(54) WELL PLATE DRIER AND COVER

(71) Applicant: Covaris, LLC, Woburn, MA (US)

(72) Inventors: Diana Sim, Brighton, MA (US); Daniel Edward Zimmerman, Rockport, MA (US); Paulina Kocjan, Waltham, MA (US); Todd Anthony Basque, West Newbury, MA (US); James A. Laugharn, Jr., Boston, MA (US)

(73) Assignee: Covaris, LLC, Woburn, MA (US)

( * ) Notice: Subject to any disclaimer, the term of this patent is extended or adjusted under 35 U.S.C. 154(b) by 686 days.

(21) Appl. No.: 16/263,030

(22) Filed: Jan. 31, 2019

(65) Prior Publication Data

US 2019/0240656 A1 Aug. 8, 2019

Related U.S. Application Data

(60) Provisional application No. 62/625,378, filed on Feb. 2, 2018.

(51) Int. Cl.
*B01L 3/00* (2006.01)
*B01L 9/00* (2006.01)

(52) U.S. Cl.
CPC ..... *B01L 3/50853* (2013.01); *B01L 3/50851* (2013.01); *B01L 9/523* (2013.01); *B01L 2200/141* (2013.01); *B01L 2300/042* (2013.01); *B01L 2300/069* (2013.01); *B01L 2300/0829* (2013.01)

(58) Field of Classification Search
CPC ..... B01L 3/50853; B01L 3/50851; B01L 2200/025; B01L 9/06
USPC ..... 422/561, 562, 552
See application file for complete search history.

(56) References Cited

U.S. PATENT DOCUMENTS

| | | | | |
|---|---|---|---|---|
| 5,282,543 | A | 2/1994 | Picozza et al. | |
| 6,136,273 | A | 10/2000 | Sequin et al. | |
| 6,159,368 | A * | 12/2000 | Moring | B01D 61/18 210/258 |
| 6,258,325 | B1 | 7/2001 | Sanadi | |
| 2005/0236346 | A1* | 10/2005 | Whitney | B01L 9/06 211/74 |
| 2010/0300547 | A1* | 12/2010 | Nomoto | B65D 19/0002 269/287 |

* cited by examiner

*Primary Examiner* — Natalia Levkovich
(74) *Attorney, Agent, or Firm* — Wolf, Greenfield & Sacks, P.C.

(57) ABSTRACT

Apparatus and method for removing liquid from exterior surfaces of sample wells in a well plate. Wells that have water or other liquid on an exterior surface, e.g., after acoustic energy treatment in a water bath, may have the liquid removed by contacting the exterior surfaces of the sample wells with an absorbent material. A pad made of absorbent material may have a plurality of openings arranged to receive an array of sample wells inserted into the openings so that liquid can be removed from each of the sample wells.

36 Claims, 4 Drawing Sheets

WELL PLATE DRIER AND COVER

RELATED APPLICATION

This application claims the benefit of U.S. Provisional Application No. 62/625,378, filed Feb. 2, 2018, which is hereby incorporated by reference in its entirety.

BACKGROUND

1. Field of Invention

Methods and apparatus for managing sample well plates are described.

2. Related Art

Well plates, sometimes called microtiter plates, microplates or multi-well plates, are widely used in laboratory and other applications for holding and processing multiple liquid samples, e.g., for diagnostic testing and research. Such plates commonly have individual sample wells arranged in a rectangular array, e.g., of 96, 384 or more sample wells. A lower portion of the wells is exposed at an underside of the well plate, e.g., to allow for treatment of the sample material held in each well in different processes like heating/cooling cycles of a PCR process or exposure to acoustic energy.

SUMMARY

In one aspect of the invention, an apparatus is provided for removing undesired liquid from the exterior of a well plate, such as from the exterior surfaces of sample wells that protrude from the bottom side of the well plate. Well plates may pick up water or other liquid on an exterior surface in different ways, such as by being placed in a puddle of waste liquid on a countertop, being partially immersed in a liquid coupling medium of an acoustic energy treatment system, washing the well plate between uses and in other ways. This water or other liquid may contaminate samples in the sample wells of the well plate or of other well plates, or otherwise interfere with proper use of the well plate, and so removing the liquid at least in part may be desirable.

In one aspect of the invention, an apparatus for removing liquid from a well plate, e.g., from exterior surfaces of sample wells protruding downwardly from an underside of the well plate, is provided. In one embodiment, a pad of absorbent material may include a plurality of openings arranged in an opening array, with the opening array configured such that each of the plurality of sample wells protruding from the underside of the well plate is receivable in a corresponding one of the plurality of openings. The exterior surfaces of the sample wells may be received by the openings in the pad such that liquid is removed from the exterior surface of the sample well. In some embodiments, the portion of the pad at the openings may contact the exterior surface of the sample wells so that liquid is removed from the sample well, e.g., by absorption.

In some embodiments, the plurality of openings of the pad may be arranged to simultaneously receive the exterior surfaces of the plurality of sample wells into corresponding ones of the plurality of openings. For example, an entire well plate may be moved downwardly over the pad so that the lower surfaces of the sample wells are inserted into the pad openings at the same time. The pad may have a body with a planar top surface, and the plurality of openings may each extend downwardly from the planar top surface into the pad body. In some cases, the pad body may include a trough formed in the pad body and extending around the plurality of openings. The trough may be configured to receive a skirt of the well plate that extends around the plurality of sample wells, e.g., as the lower portions of the sample wells are inserted into corresponding openings of the pad. The openings in the pad may be shaped in different ways, e.g., each having a tapered shape such that an upper portion of each opening is larger than a lower portion of each opening. This arrangement may be useful so the opening can conform to a shape of the corresponding sample well. For example, the plurality of openings may each have a conical shape that conforms to a conical shape of a corresponding sample well. In other arrangements, the openings may have a cylindrical shape such that the openings are not tapered. Such an arrangement may operate with sample wells having a cylindrical shape, or if the portion of the pad at the openings is made of a resilient or compliant material, the portion of the pad at the openings may deform to the shape of the sample well received. Close conformance of the opening to the corresponding sample well exterior surface may aid in removal of liquid, including where the portion of the pad at the opening is not compliant, e.g., is made of a rigid material. All or part of a sample well may be received into an opening, e.g., the plurality of openings may each be arranged to receive an entire exterior surface of a corresponding sample well that protrudes downwardly from the underside of the well plate.

In some embodiments, a frame may extend around the pad and support the pad such that the frame and pad are movable together by grasping and moving the frame. For example, in some cases the pad may be made of a material that is not structurally robust, and the frame may support the pad so that the pad can be lifted and moved without difficulty, e.g., where the pad is made of a material incapable of physically supporting itself when wet (or dry). The frame may include walls that extend around the pad and a floor that extends between the walls of the frame and supports a bottom surface of the pad. In some cases, the pad has a top surface into which a plurality of openings extend, and the top surface may be recessed below an upper surface of the frame. This may allow the frame and pad to be inverted, i.e., turned over so the top surface of the pad faces downwardly, for placement of the upper surface of the frame on a flat support surface. Since the top surface of the pad is recessed from the upper surface of the frame, the pad may be supported by the frame without the top surface contacting the flat support surface. This may help reduce the chances of a contaminant being transferred from the pad to the support surface, or from the support surface to the pad. In some arrangements, the frame may aid in allowing the pad assembly to be more easily used in automated plate handling systems. For example, the frame may provide physical support to the pad, allowing a robotic handler to pick up and move the pad assembly. The frame may include other features, such as stacking features that allow multiple pad assemblies to be stacked on top of each other. For example, a lower portion of the frame may be sized or shaped to fit inside or, or around, an upper portion of the frame of another pad assembly. This could allow an automated plate handler, or human user, to stack multiple frame and pad assemblies on top of each other in a single stack. Note that such stacks could also include well plates, e.g., where a well plate is positioned between two pad assemblies where a bottom surface of the well plate is in contact with the pad of a lower pad assembly (e.g., to remove liquid from the underside of the well plate) and an upper surface of the well plate is covered by an upper pad assembly (e.g., to cover sample wells in the plate).

In some embodiments, the pad may be combined with one or more caps used to cover top openings of sample wells of a well plate. For example, the pad may have a top surface from which the plurality of openings extend into the pad, and an array of caps may be arranged on a side of the pad opposite the top surface, e.g., at the bottom side of the pad. The array of caps may be configured to be placed over an upper side of the well plate to cover the plurality of sample wells, with each of the array of caps being configured to cover a corresponding one of the plurality of sample wells. This may allow the caps to keep sample material in the corresponding sample wells, and/or help prevent unwanted material from entering the sample wells. In some cases, each of the plurality of caps may include a convex portion arranged to be partially received into a corresponding sample well to cover the sample well. For example, the convex portion may be shaped as an inverted dome shape or as a cylindrical plug arranged to engage with a corresponding sample well, e.g., by having a portion of the cap fit inside and/or around an upper opening of the sample well. Where the pad is supported by a frame, the frame may support both the pad and the plurality of caps such that the frame, pad and plurality of caps are movable together by grasping and moving the frame. In one embodiment, the frame includes walls that extend around the pad and a floor that extends between the walls of the frame and supports a bottom surface of the pad, and the plurality of caps are arranged on a side of the floor opposite the pad. The plurality of caps may be arranged in a plane that is recessed below a lower surface of the frame, e.g., so the frame can support the caps above an underlying support surface so the caps do not contact the support surface. The plurality of caps may be formed as part of a sheet in which each of the plurality of caps extends from the sheet, e.g., where the caps and sheet are molded in a single operation, and a cap support plate having a plurality of cap openings may each receive a corresponding cap and support the caps and sheet.

Not all arrangements of a pad assembly need include a pad that has openings to receive protruding portions of sample wells. For example, some well plate configurations have sample wells formed so that the wells do not individually protrude from an underside of the well plate. Instead, the array of sample wells are formed to present a flat surface at an underside of the well plate. In such a case, a pad may include no openings to receive sample wells, but rather may include a flat top surface arranged to contact the flat bottom surface of the well plate and receive liquid from the well plate. Thus, a pad may include a flat top surface with no openings of any kind formed into the pad. Note that a pad having a top surface with no openings may be used with well plates that have downwardly protruding sample well portions at an underside of the well plate. For example, the pad may be made of a resilient or compliant material to receive protruding sample well portions, or the pad may be made of a rigid material and such that contact with only a lowermost portion of the well plate operates to remove sufficient liquid from the well plate.

Other pad arrangements are possible as well, such as a pad that includes a plurality of upstanding or vertical fingers or pins. The fingers or pins may be relatively small in size, e.g., 1-5 mm diameter cylinders, and may be arranged to individually fit between downwardly protruding sample wells, e.g., like a bristles of a brush. The fingers or pins may be absorbent or otherwise capable of receiving liquid from the exterior portions of the well plate, e.g., by capillary action, cohesion, etc. For example, fingers or pins may be made of a non-absorbing material, but may receive liquid by cohesion or physically wiping liquid from an underside of the well plate. The fingers or pins may be resilient, e.g., to bend or give way with contact of sample well portions, and recover their shape and/or vertical orientation when the well plate is removed from the pad. The brush-like arrangement for the pad may be advantageous as it may allow the pad to operate with a variety of differently arranged well plates, including those with different numbers or configurations of downwardly protruding sample wells and/or flat bottom configurations.

For pad arrangements that include no openings in a top surface of the pad, a brush-like arrangement with fingers or pins, or other pad configurations, other features described above may be combined with the pad assembly, such as a frame to extend around and support the pad, arranging the pad top surface to be recessed below the upper surface of the frame, providing one or more caps on a side of the pad opposite the top surface of the pad, and so on. A trough may be provided in the pad to receive a skirt of such a well plate, but in some cases no trough need be provided in the pad, e.g., because not all well plates include such a skirt.

In another aspect of the invention, a method for handling a well plate includes providing a well plate having a plurality of sample wells arranged in an array, with each of the sample wells having an exterior surface at an underside of the well plate and each of the plurality of sample wells holding a sample material. The well plate may be positioned so that the exterior surface of the sample wells contacts a liquid coupling medium arranged to transmit acoustic energy from an acoustic energy source to the sample wells, e.g., so that the sample material may be treated with focused acoustic energy transmitted by the coupling medium. The sample wells may be removed from contact with the liquid coupling medium, and the exterior surface of the plurality of sample wells contacted with a pad of material to remove any liquid coupling medium from the exterior surface of the plurality of sample wells.

In some embodiments, the step of contacting the exterior surface includes inserting downwardly protruding portions of the plurality of sample wells into corresponding openings in the pad arranged in an opening array. For example, the well plate may be positioned over the pad, the plurality of sample wells aligned with corresponding ones of the plurality of openings, and the well plate lowered over the pad. In other arrangements, well plate portions need not be received into corresponding openings, but rather lower surfaces of the sample wells may contact a top surface of the pad. The pad may include a trough, e.g., around a plurality of openings so a skirt around the plurality of sample wells of the well plate can be inserted into the trough while portions of the sample wells contact the pad. An array of caps may be arranged on a side of the pad opposite the plurality of openings, and the array of caps may be positioned over an upper side of the well plate, and put into contact with the plurality of sample wells so the array of caps closes the plurality of sample wells.

Other advantages and novel features of the invention will become apparent from the following detailed description of various non-limiting embodiments when considered in conjunction with the accompanying figures and claims.

BRIEF DESCRIPTION OF THE DRAWINGS

Aspects of the invention are described with reference to the following drawings in which numerals reference like elements, and wherein.

DETAILED DESCRIPTION

Figure 1:
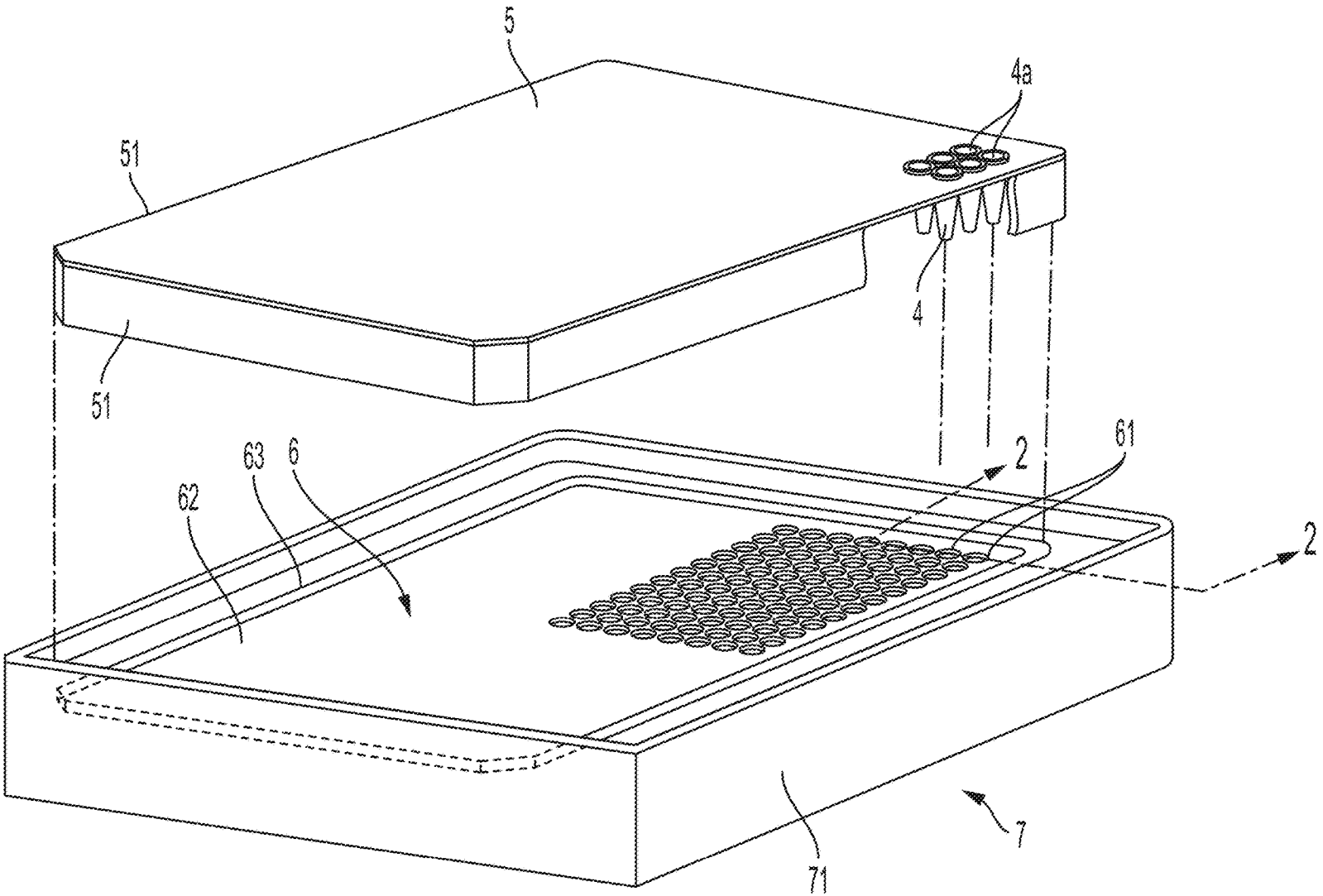
FIG. 1 is a perspective view of a well plate and apparatus for removing liquid from the well plate in an illustrative embodiment.

FIG. 1 shows a perspective view of an apparatus that can be used to remove liquid from an exterior surface of a well plate and/or to cover sample wells in a well plate. In this illustrative embodiment, the apparatus includes a pad 6 that may include an absorbent material to receive liquid from an exterior surface of a well plate 5, e.g., upon contact of the liquid with the pad 6. A well plate 5 may have liquid on its exterior surface for various reasons, and the presence of the liquid may be undesirable. For example, in manual and/or automated sample handling operations, a well plate may receive liquid on its exterior surface due to washing of the well plate (e.g., to allow reuse of the well plate), accidental pipetting or other discharge of liquid onto the well plate exterior, placement of the well plate onto a table top or other surface that has liquid on it, and/or sample treatment processes that cause the well plate exterior to be wetted as part of the process. As discussed in more detail below, sample material held in sample wells of a well plate 5 may be treated with acoustic energy for various purposes, such as mixing, lysing of tissue and/or cells, shearing of DNA or other nucleic acid, and others. Some of these acoustic energy treatment processes involve immersing at least part of the sample wells of a well plate in a liquid coupling medium, such as water. The coupling medium aids in transmitting acoustic energy from a source to the sample wells, and once treatment is complete, the well plate may be removed from the coupling medium yet still retain at least some liquid on its exterior surface. This liquid may interfere with sample handling operations, e.g., liquid on the well plate exterior may drip into the sample wells of other well plates, may interfere with sample well heating such as during PCR processing, etc. Thus, it may be desirable to remove or otherwise reduce an amount of liquid on an exterior surface of a well plate. Of course, it should be understood that a well plate may receive liquid on its outer surface in any number of different ways, such as contact with any fluid bath for any purpose (such as thermocycling or incubation) and at a variety of temperatures, e.g., from −68 degrees C. to 150 degrees C. Thus, liquid may be received by the plate in solid (e.g., ice) or vapor form and in any way.

In the illustrative embodiment of FIG. 1, the pad 6 may be arranged to receive liquid from the exterior surface of sample wells 4 of the well plate 5, e.g., at an underside of the well plate 5. For example, the sample wells 4 may include lower portions that protrude downwardly from an underside of the well plate 5, and it is these downwardly protruding portions that may be immersed in a liquid coupling medium for acoustic treatment, or received by heating elements of a PCR processing machine, etc. To remove liquid from the exterior surface of the sample wells 4, the sample wells 4 may be contacted by the pad 6 so that liquid can be transferred to the pad 6. In this embodiment, the pad 6 includes a planar top surface 62 and a plurality of openings 61 that extend into the body of the pad 6 from the top surface 62. Although FIG. 1 shows only a few sample wells 4 of the well plate 5, it will be understood that the well plate 5 may include any suitable number of sample wells 4, e.g., in a standard rectangular array of 24, 48, 96, 384, 1536, etc. sample wells. Likewise, FIG. 1 shows only a few openings 61, but the pad 6 may include a plurality of openings 61 arranged in a corresponding array so that each of the sample wells 4 may be received into a corresponding one of the plurality of openings 61. The openings 61 may be arranged to contact the exterior surface of the received sample well 4 so that liquid can be absorbed or otherwise received by the pad 6 and removed from the well plate 5. In some cases, the pad 6 may be made of or otherwise include an absorbent material such as a paper or cellulose material, a woven or non-woven polymer or other material, etc. In one embodiment, the pad may be arranged as a sponge formed of polyvinyl acetate material or polyurethane foam, though other arrangements are possible. The pad 6 may receive liquid from the well plate 5 in any suitable physical process, such as by capillary action, vacuum or other suction, adhesion, a wiping action (like a windshield wiper on an automobile window), surface tension, and others. Thus, a pad 6 may absorb or otherwise receive liquid from well plate 5 even though the material of the pad 6 itself is not absorbent. Instead, a pad 6 may be made of a non-absorbent material arranged to hold water or other liquid by surface tension, capillary action, or other processes. It should be understood that the pad 6 need not dry the exterior surface of sample wells 4, but rather may act to remove enough water or other liquid so as to prevent undesired dripping or other separate of the liquid from the well plate 5.

Figure 2:
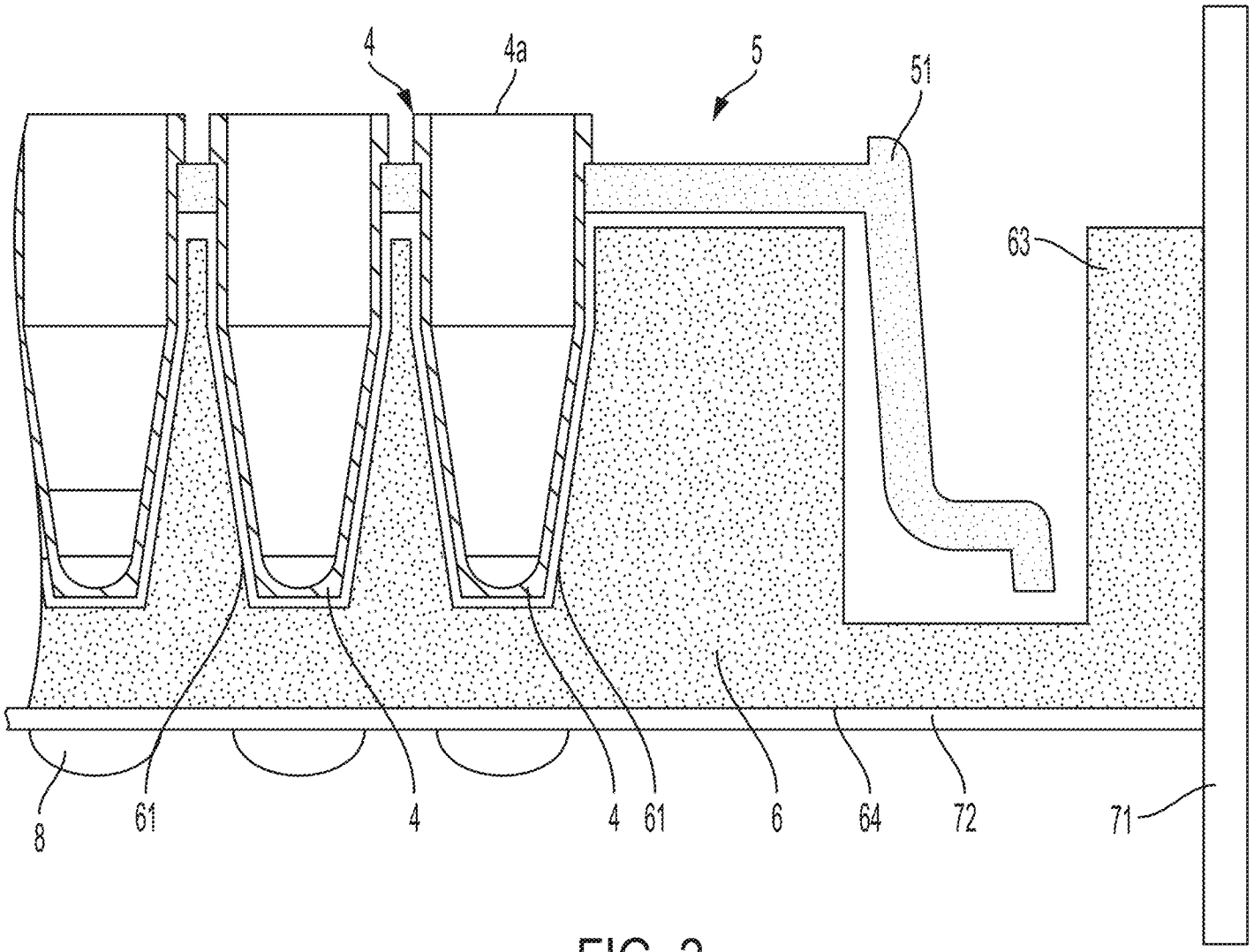
FIG. 2 shows a cross sectional view of the assembled well plate and apparatus along the line 2-2 in FIG. 1.

FIG. 2 shows a cross sectional view along the line 2-2 of FIG. 1 and illustrates how sample wells 4 of a well plate 5 may be received into openings 61 of a pad 6. In this embodiment, the openings 61 are formed to have a shape that is identical or otherwise similar to the shape of the external surface of the sample well 4 that is received. This may aid in ensuring suitable contact between the pad 6 and the sample wells 4 if needed to ensure suitable liquid transfer and/or if the pad 6 is made of a relatively rigid or non-compliant material. However, in other embodiments, the openings 61 need not be made to the shape of sample wells 4 to be received. Instead, the openings 61 may be made to have a similar shape as, but smaller than, a received sample well 4 so that the portion of the pad 6 at the opening 61 must expand when receiving a sample well 4. In other embodiments, the openings 61 may be made to have a shape that is different from a sample well 4 to be received, e.g., the openings 61 may be formed as relatively small radius cylindrical holes to receive sample wells 4 having a conical shape like that in FIG. 2. This arrangement may provide for suitable contact of the pad 6 with sample wells 4, as well as allow the pad 6 to be used with well plates 5 that have differently shaped sample wells. That is, some well plates 5 have sample wells 4 with a rectangular box-like shape, a cylindrical shape, or other arrangement, and the openings 61 may be sized and shaped to operate with a variety of differently sized and shaped sample wells 4. As another example, in some embodiments the pad 6 may include a thin membrane at the top surface 62 arranged with openings 61 to receive sample wells 4. The membrane may be backed by a more rigid support, such as a rigid foam having holes aligned with openings 61 in the membrane. The membrane-formed openings 61 may function as a wiper or squeegee that wipes liquid from the sample wells 4 as the exterior surface is received by the opening 61. The liquid may be channeled to a gutter or other drain, or may be absorbed or otherwise received by another portion of the pad 6. It should be understood, however, that the openings 61 may be made very simply, e.g., as dimples in the top surface 62 of the pad 6, and the pad 6 may be made of a resilient and/or conformal material so that sample wells 4 can be received by pressing the well plate 5 downwardly on the pad 6.

It should be understood that a pad 6 need not include openings 61 to receive a corresponding well portion, and may be arranged in other ways to suitably contact an exterior surface of the well plate 5. For example, the pad 6 may include a plurality of vertical fingers or pins that are suitably spaced and arranged to engage with a variety of differently arranged well plates. In some embodiments, the fingers or pins may be relatively small in diameter, e.g., 1-2 mm, and relatively long, e.g., 10 mm or more, so that the fingers or pins may accommodate a variety of differently arranged well plates. For example, the fingers or pins may bend, move or otherwise conform to well plates having differently sized, shaped and spaced sample wells at the underside of the plate 5. Thus, the pad 6 may form a kind of brush where the bristles—the fingers or pins—can move between sample well exterior surfaces of various configurations to remove liquid. The fingers or pins may be made absorbent, compliant, resilient, or in any suitable way.

In other embodiments, however, the well plate 5 need not be received to any great extent by the pad 6 but instead the pad 6 may simply contact a lowermost portion of the sample wells 4 since this action may be sufficient to remove liquid. In such cases, the pad 6 need not be made resilient or compliant. For example, some well plates have sample wells formed very close together, or actually in contact with each other, so the underside of the well plate 5 presents a flat or nearly flat surface where the sample wells 4 are located. To operate with such well plates, a pad 6 may have no openings 61 at all, and instead may have a flat top surface with no openings extending into the pad 6. In this arrangement, the pad 6 may contact the flat or nearly flat underside of the well plate 5 to remove liquid. This arrangement may function suitably with well plates 5 that have sample wells 4 that protrude from an underside of the well plate 5, but the density of the sample wells 4 leaves very little space between adjacent sample wells 4. Contacting only a lowermost surface of the sample wells 4 with a flat top surface of a pad 6 may be sufficient in such arrangements to remove a suitable amount of liquid from the well plate 5.

Some well plates 5, like the one in FIGS. 1 and 2, include a skirt 51 or frame that surrounds the sample wells 4 and extends downwardly from an upper surface of the well plate 5. This skirt 51 can provide different functions, including providing a gripping surface for a person or automated plate handler to pick and move the well plate 5, providing strength or rigidity to the well plate 5 (e.g., to help resist bending or warping caused by physical contact or heating of the well plate 5), and/or supporting the well plate 5 on a flat support surface such as a table top while holding the sample wells 4 above the support surface. To accommodate well plates 5 having a skirt 51, the pad 6 may include a trough 63 arranged to receive the skirt 51, allowing sample wells 4 to be suitably engaged at openings 61 of the pad 6. The trough 63 may be made suitably to avoid contact with the skirt 51, and may allow for a gripper of an automated plate handler to engage with the skirt 51 without contacting the pad 6. Of course, in other embodiments, the portion of the pad 6 at the trough 63 may engage with the skirt 61, e.g., at an inside and/or outside surface to remove liquid from the skirt 51. In other embodiments, the pad 6 may be sized to fit inside of the skirt 51 of a well plate 5, avoiding any need for a trough 63 and/or any concern of the skirt 51 contacting the pad 6. For well plates 5 not having a skirt 51, a pad 6 need not include a trough 63.

While not required, in this embodiment the pad 6 is supported by a frame 7 that includes sidewalls 71 that extend around the pad 6 and a floor 72 that engages with a bottom surface 64 of the pad 6. (Although the walls 71 extend entirely around the pad 6 in this embodiment, the walls 71 may extend around the pad 6 to a lesser extent, e.g., along one or two sides of the pad 6.) In this embodiment, the top surface 62 of the pad 6 is recessed relative to an upper surface of the walls 71, e.g., so that the frame 7 and pad 6 can be inverted and placed on a flat support surface such as a table top without the pad 6 contacting the support surface. This may help reduce the chance that the pad 6 will receive liquid and/or contaminants from the support surface which could be undesirably transferred to a well plate 5. In addition, or alternately, having the pad 6 top surface 62 recessed from the upper surface of the walls 71 (or other frame 7 portion) may allow two or more frame/pad assemblies to be stacked on top of each other. For example, a lower surface of the walls 71 may be sized and/5 or shaped to fit within or around the upper surface of the walls 71 of another frame/pad assembly. This can allow the frame/pad assemblies to be stacked one on top of another and without having the pad top surface 62 contact any portion of an overlying frame/pad assembly. It will be understood that other locating structure may be used to engage frame/pad assemblies when stacked together, such as tongue and groove engagement, pin and slot engagement, etc. Note also that the frame/pad assembly may be arranged to allow a well plate 5 to be nested between upper and lower frame/pad assemblies. A lower frame/pad assembly may function to remove liquid from the well plate 5, and an upper frame/pad assembly may include caps to enclose sample wells 4 of the plate 5. (Cap arrangements are discussed in more detail below.) Thus, a well plate may be sandwiched between upper and lower pad assemblies to remove liquid at the underside and cover sample wells at the upper side. This arrangement may allow for compact storage of multiple well plates, e.g., while waiting in a queue for processing in an automated or manual plate processing system.

The floor 72 of the frame 7 may provide vertically oriented support for the pad 6, e.g., helping prevent the pad 6 from contacting a table top or other support surface at a bottom of the pad 6 when the pad 6 engages with a well plate 5 that is pressed downwardly onto the pad 6. The floor 72 may include one or more openings so that liquid in the pad 6 can be released downwardly from the pad 6, e.g., if the pad 6 is squeezed in a downward direction in an attempt to remove liquid from the pad 6. For example, after a pad 6 is used to remove liquid from multiple well plates 5, the pad 6 may become saturated. If the pad 6 is made to be resilient, the pad 6 may be pressed by a flat platen that reduces the vertical thickness of the pad 6 and squeezes liquid from the pad 6. The released liquid may exit through openings in the floor 72 or other pathway.

FIG. 2 illustrates another feature that may be incorporated with a pad 6 used to remove liquid from a well plate 5, i.e., that caps 8 may be provided with the pad 6 to cover sample wells 4 of a well plate 5. In this embodiment, the floor 72 includes a plurality of caps 8 that are arranged in an array that corresponds to the array of sample wells 4 of the well plate 5. Thus, after the well plate 5 is removed from the pad 6, the assembly may be positioned over the upper side of the well plate 5 and the caps 8 lowered onto the sample wells 4 so as to close the sample wells 4. Engagement of the caps 8 with the sample wells 4 may provide a leak-proof seal with the sample wells 4, e.g., so that liquid sample material in the sample wells 4 cannot be released from the sample wells 4 even in the case that the well plate 5 and caps 8 are inverted. In other embodiments, the caps 8 may simply help prevent material from undesirably entering the sample wells 4, but without providing a leak-proof seal. In yet other arrangements, the caps 8 may help prevent sample material from exiting a sample well 4, whether by evaporation or by splashing or splattering caused by treatment of the sample material. For example, acoustic treatment can cause sample material to be splashed or moved vigorously in a sample well, and a cap 8 may help keep the sample material in the sample well 4 during acoustic processing. In this embodiment, the caps 8 are formed to have a convex surface that is at least partially received into the upper opening of a corresponding sample well 4. For example, the caps 8 may have a dome shape, a cylindrical plug shape, or otherwise arranged convex portion, but this is not required. Instead, for example, the caps 8 may be provided by a single sheet of resilient material having a constant thickness throughout. That is, the caps 8 need not be or include defined shapes or other features to engage with a well plate, but instead may be formed by a portion of a flat sheet used to cover an array of sample wells 4. Such an arrangement may be useful, for example, where sample wells are sealed by a foil or film layer and the caps 8 simply provide additional protection against accidental rupture of the foil or film sealing layer.

Figure 3:
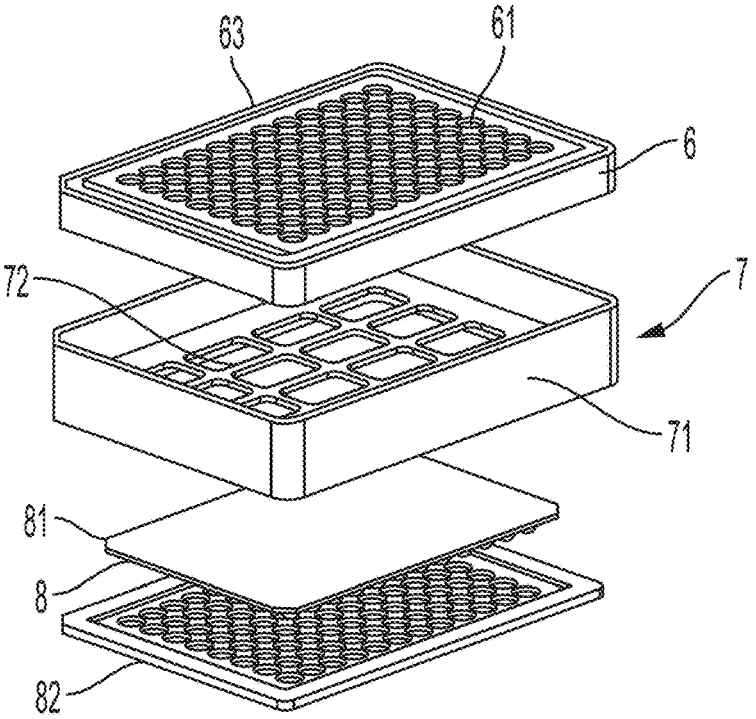
FIG. 3 is a top side perspective exploded view of an apparatus for removing liquid from and covering sample wells in another illustrative embodiment.
Figure 4:
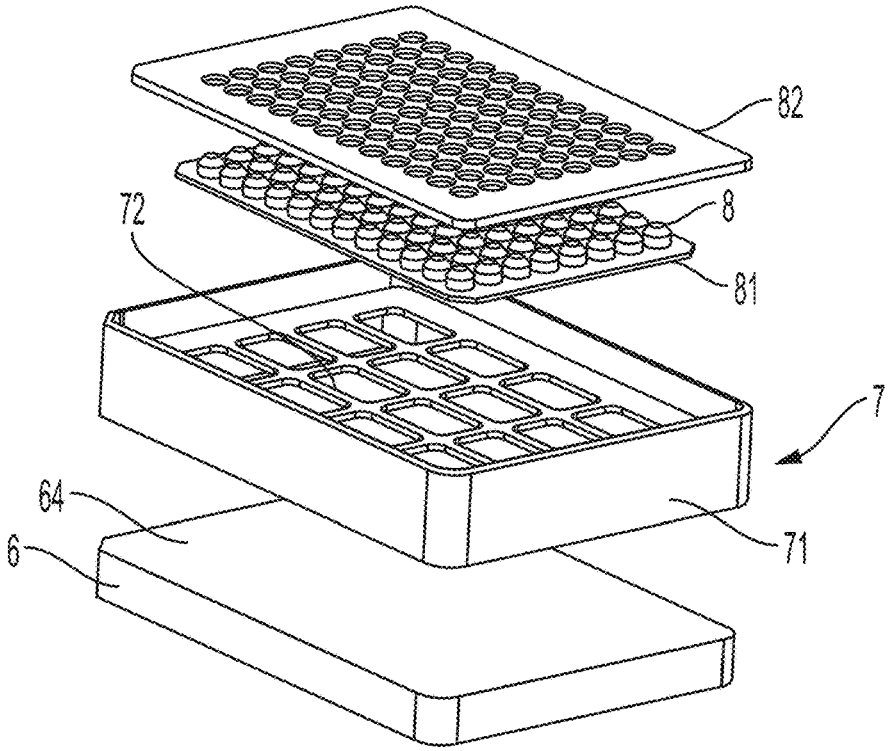
FIG. 4 is an perspective exploded view of the FIG. 3 apparatus in an inverted orientation relative to FIG. 3.

FIGS. 3 and 4 show exploded views of another assembly that includes a pad 6 similarly arranged to that in FIGS. 1 and 2 as well as a plurality of caps 8 arranged on a side of the pad 6 opposite the openings 61. However, unlike the FIG. 2 embodiment, in this case the caps 8 are arranged on a sheet 81. For example, the caps 8 and the sheet 81 may be molded at the same time from a resilient or other suitable material, such as a silicone, and the caps 8 may protrude from the sheet 81. Arranging the caps 8 on a sheet 81 may help keep the caps 8 in suitable position as well as make assembly with the pad 6 easier. In this embodiment, the caps 8 extend through corresponding holes in a support plate 82, which may help keep the caps 8 in proper position of a desired array, as well as keep the caps 8 arranged in a desired plane. The support plate 82 may also function as a stop, i.e., the support plate 82 and caps 8 may be pressed downwardly onto the top surface of a well plate 5 until the support plate 82 contacts the well plate 5. The support plate 82 may be made of a rigid material with holes formed to suitably receive and hold resilient cap 8 elements. Providing an assembly with both a pad 6 and caps 8 may allow for convenient handling of a well plate. For example, the caps 8 may be used to cover the sample wells 4 in a well plate 5 as the plate 5 is moved to an acoustic treatment station, e.g., to help keep contaminants from entering the sample wells 4. Once at the treatment station, the caps 8 may be removed and the well plate 5 placed in a liquid coupling medium so the sample material in the wells can be treated with acoustic energy. Alternately, the caps 8 may be left on the well plate 5 during acoustic treatment, e.g., to help keep sample material in the wells 4. After acoustic treatment is complete, the well plate 5 and pad/cap assembly may be removed from the coupling medium and the exterior surface of the sample wells 4 at the underside of the plate 5 engaged with the pad 6 to remove liquid from the exterior surface. (If the caps 8 were left on the well plate 5 during acoustic treatment, the caps 8 may be removed, and the cap/pad assembly placed with the pad top surface 62 exposed. Thereafter, the well plate 5 may be positioned over the pad 6 to remove liquid that may remain from the acoustic treatment process.) With liquid removed from the well plate 5, the caps 8 may be again placed over the top openings of the sample wells 4 and the well plate 5/pad and cap assembly moved to the next station.

As will be understood, a pad 6 or pad 6/cap 8 assembly may be useful for handling one or more well plates 5, particularly in an automated plate handling system that uses one or more robotic systems to move well plates between different treatment stations. Such systems are well known, and may include a plate washing station to allow for reuse of plates. In some embodiments, the system may include an acoustic treatment station that includes a liquid coupling medium in which well plates are partially immersed so samples in the sample wells of the plate can be treated with acoustic energy. A manual or automated plate handling system can use a pad 6 to remove unwanted liquid from well plates, e.g., after washing or acoustic treatment. For example, a robotic handler may position a well plate in a liquid coupling medium of an acoustic treatment station and hold the plate in place until treatment is complete. Afterwards, the handler may engage the well plate with a pad 6 to remove unwanted liquid, e.g., by lowering the well plate onto a pad 6. If desired, and the pad assembly is suitably equipped, the robotic handler may flip the pad 6/cap 8 assembly over and place the array of caps 8 over the open top openings of the sample wells 4. The covered well plate 5 may then be moved by the robotic handle to a subsequent treatment station. A pad 6 may have liquid removed from it in different ways, such as by heating, physical wringing or compression, vacuum, or other processes.

Figure 5:
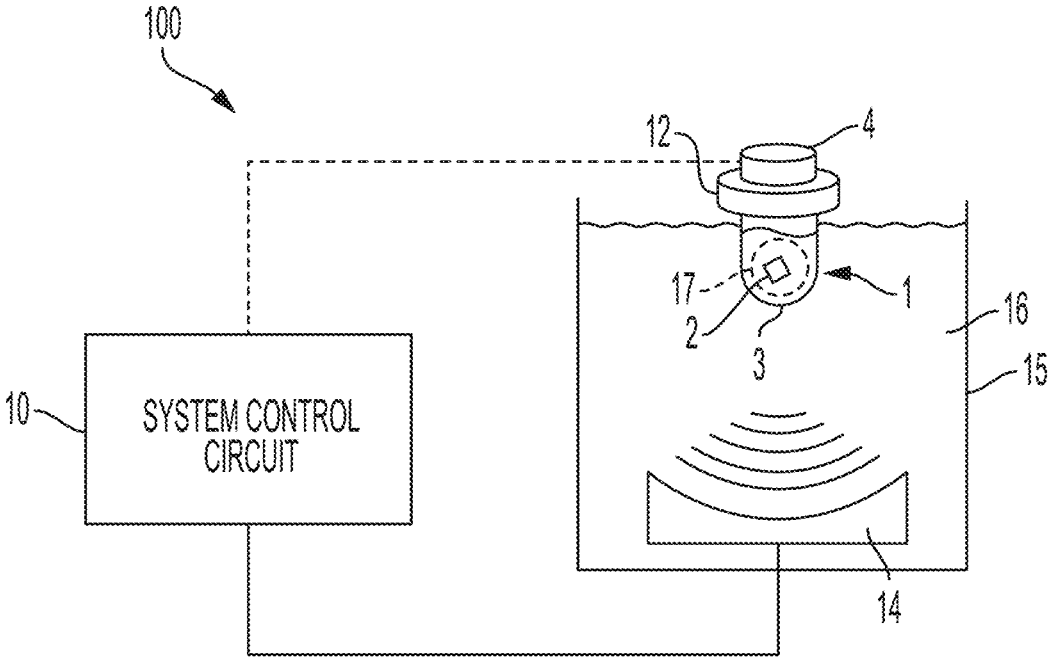
FIG. 5 shows an acoustic treatment system that may be used to treat sample material in sample wells of a well plate.

FIG. 5 shows a schematic block diagram of an acoustic treatment system 100 that may be used to provide focused acoustic treatment to sample material in one or more sample wells of a well plate. "Sonic energy" or "acoustic energy" as used herein is intended to encompass such terms as acoustic waves, acoustic pulses, ultrasonic energy, ultrasonic waves, ultrasound, shock waves, sound energy, sound waves, sonic pulses, pulses, waves, or any other grammatical form of these terms, as well as any other type of energy that has similar characteristics to sonic energy. In this illustrative embodiment, the acoustic treatment system 100 includes an acoustic energy source with an acoustic transducer 14 (e.g., including one or more piezoelectric elements) that is capable of generating an acoustic field (e.g., at a focal zone 17) suitable to cause mixing, e.g., caused by cavitation, and/or other effects in a sample 1 contained in a sample well 4. The sample 1 may include "solid" particles, such as cells, or other material 2, such as DNA or other nucleic acid material, one or more enzymes, etc. and/or liquid 3, such as liquid reagents, water, a crowding agent, etc. FIG. 5 shows only one sample well 4 for clarity, but it will be understood the sample well 4 may be one of a plurality of sample wells 4 of a well plate 5. The well plate 5 may be supported by a vessel holder 12 shown schematically in FIG. 5. Although a vessel holder 12 is not necessarily required, the vessel holder 12 may interface with a control circuit 10 so that the sample well 4 and/or other wells 4 of the associated well plate 5 is positioned in a desired location relative to an acoustic field, for example, at least partially within a focal zone 17 of acoustic energy. The vessel holder 12 may be arranged to support the sample well(s) 4 in a single location, or may be arranged to move the sample well(s) 4, e.g., using a robotic system, movable stage or other drive system. In this embodiment, the sample well(s) 4 is a polymer tube having an internal volume of 50 microliters or less (e.g., 20 microliters), but it should be understood that the sample well(s) 4 may have other suitable shapes, sizes, materials, or other features, as discussed above. The sample well(s) 4 may be formed of glass, plastic, metal, composites, and/or any suitable combinations of materials, and formed by any suitable process, such as molding, machining, stamping, and/or a combination of processes.

As can be seen in FIG. 5, a container 15 may contain the acoustic transducer 14 or other acoustic energy source, the sample well(s) 4 as well as a coupling medium 16. The container 15 may take any suitable size, shape or other configuration, and may be made of any suitable material or combination of materials (such as metal, plastic, composites, etc.). In this illustrative embodiment, the container 15 has a jar- or can-like configuration with an opening arranged to permit access to an internal volume of the container 15. The container 15 may be arranged to hold any suitable coupling medium 16, such as water or another liquid, gas (e.g., air, inert gas), gel (e.g., silicone), solid (e.g., elastomeric material), semi-solid, and/or a combination of such components, which transmits acoustic energy from the transducer 14 to the sample well(s) 4. The acoustic energy source 14 and the coupling medium 16 (such as water or other liquid) may be positioned in the container 15, e.g., with the acoustic energy source 14 near a bottom of the container 15. The sample well(s) 4 can be lowered into the container 15, e.g., so that the sample well(s) 4 is partially or completely submerged in the coupling medium 16. The coupling medium 16 may function as both an acoustic coupling medium, e.g., to transmit acoustic energy from the acoustic energy source 14 to the sample well(s) 4, as well as a thermal coupling medium, e.g., to accept heat energy from the sample well(s) 4.

Under the control of the control circuit 10 (described in more detail below), the acoustic transducer 14 may produce acoustic energy within a frequency range of between about 100 kilohertz and about 100 megahertz such that the focal zone 17 has a width of about 2 centimeters or less. The focal zone 17 of the acoustic energy may be any suitable shape, such as spherical, ellipsoidal, rod-shaped, or column-shaped, for example, and be positioned at the sample 1. The focal zone 17 may be larger than the sample volume, or may be smaller than the sample volume, as shown in FIG. 5. U.S. Pat. Nos. 6,948,843 and 6,719,449 are incorporated by reference herein for details regarding the construction and operation of an acoustic transducer and its control. The focal zone may be stationary relative to the sample, or it may move relative to the sample.

In some embodiments, the transducer can be formed of a piezoelectric material, such as a piezoelectric ceramic. The ceramic may be fabricated as a "dome", which tends to focus the energy. One application of such materials is in sound reproduction; however, as used herein, the frequency is generally much higher and the piezoelectric material would be typically overdriven, that is driven by a voltage beyond the linear region of mechanical response to voltage change, to sharpen the pulses. Typically, these domes have a longer focal length than that found in lithotriptic systems, for example, about 20 cm versus about 10 cm focal length. Ceramic domes can be damped to prevent ringing or undamped to increase power output. The response may be linear if not overdriven. The high-energy focus zone 17 of one of these domes is typically cigar-shaped. At 1 MHz, the focal zone 17 is about 6 cm long and about 2 cm wide for a 20 cm dome, or about 15 mm long and about 3 mm wide for a 10 cm dome. The peak positive pressure obtained from such systems at the focal zone 17 is about 1 MPa (mega Pascal) to about 10 MPa pressure, or about 150 PSI (pounds per square inch) to about 1500 PSI, depending on the driving voltage. The focal zone 17, defined as having an acoustic intensity within about 6 dB of the peak acoustic intensity, is formed around the geometric focal point. It is also possible to generate a line-shaped focal zone, e.g., that spans the width of a multi-well plate and enables the system 1 to treat multiple wells simultaneously.

To control an acoustic transducer 14, the system control circuit 10 may provide control signals to a load current control circuit, which controls a load current in a winding of a transformer. Based on the load current, the transformer may output a drive signal to a matching network, which is coupled to the acoustic transducer 14 and provides suitable signals for the transducer 14 to produce desired acoustic energy. Moreover, the system control circuit 10 may control various other acoustic treatment system 100 functions, such as positioning of the sample well(s) 4 and/or acoustic transducer 14 (e.g., by controlling the vessel holder 12 to suitably move and hold the sample well(s) 4 in a desired location), receiving operator input (such as commands for system operation by employing a user interface), outputting information (e.g., to a visible display screen, indicator lights, sample treatment status information in electronic data form, and so on), and others. Thus, the system control circuit 10 may include any suitable components to perform desired control, communication and/or other functions. For example, the system control circuit 10 may include one or more general purpose computers, a network of computers, one or more microprocessors, etc. for performing data processing functions, one or more memories for storing data and/or operating instructions (e.g., including volatile and/or non-volatile memories such as optical disks and disk drives, semiconductor memory, magnetic tape or disk memories, and so on), communication buses or other communication devices for wired or wireless communication (e.g., including various wires, switches, connectors, Ethernet communication devices, WLAN communication devices, and so on), software or other computer-executable instructions (e.g., including instructions for carrying out functions related to controlling the load current control circuit as described above and other components), a power supply or other power source (such as a plug for mating with an electrical outlet, batteries, transformers, etc.), relays and/or other switching devices, mechanical linkages, one or more sensors or data input devices (such as a sensor to detect a temperature and/or presence of the medium 16, a video camera or other imaging device to capture and analyze image information regarding the sample well(s) 4 or other components, position sensors to indicate positions of the acoustic transducer 14 and/or the sample well(s) 4, and so on), user data input devices (such as buttons, dials, knobs, a keyboard, a touch screen or other), information display devices (such as an LCD display, indicator lights, a printer, etc.), and/or other components for providing desired input/output and control functions. Also, the control circuit 10 may include one or more components to detect and control a temperature of the coupling medium 16, such as a refrigeration system to chill the coupling medium 16, a degassing system to remove dissolved gas from the coupling medium 16, etc. Circulating the coupling medium 16 may allow the control circuit 10 to remove portions of the coupling medium 16 from the container 15 for processing, such as degassing, chilling, replacement, addition of compounds, etc.

Although not necessarily critical to employing aspects of the invention, in some embodiments, sample treatment control may include a feedback loop for regulating at least one of acoustic energy location, frequency, pattern, intensity, duration, and/or absorbed dose of the acoustic energy to achieve the desired result of acoustic treatment. One or more sensors may be employed by the control circuit 10 to sense parameters of the acoustic energy emitted by the transducer 14 and/or of the sample material 1, and the control circuit 10 may adjust parameters of the acoustic energy and/or of the sample material 1 (such as flow rate, concentration, etc.) accordingly. Thus, control of the acoustic energy source may be performed by a system control unit using a feedback control mechanism so that any of accuracy, reproducibility, speed of processing, control of temperature, provision of uniformity of exposure to sonic pulses, sensing of degree of completion of processing, monitoring of cavitation, and control of beam properties (including intensity, frequency, degree of focusing, wave train pattern, and position), can enhance performance of the treatment system. A variety of sensors or sensed properties may be used by the control circuit for providing input for feedback control. These properties can include sensing of temperature of the sample material; sonic beam intensity; pressure; coupling medium properties including temperature, salinity, and polarity; sample material position; conductivity, impedance, inductance, and/or the magnetic equivalents of these properties, and optical or visual properties of the sample material. These optical properties, which may be detected by a sensor typically in the visible, IR, and UV ranges, may include apparent color, emission, absorption, fluorescence, phosphorescence, scattering, particle size, laser/Doppler fluid and particle velocities, and effective viscosity. Sample integrity and/or comminution can be sensed with a pattern analysis of an optical signal from the sensor. Particle size, solubility level, physical uniformity and the form of particles could all be measured using instrumentation either fully standalone sampling of the fluid and providing a feedback signal, or integrated directly with the focused acoustical system via measurement interface points such as an optical window. Any sensed property or combination thereof can serve as input into a control system. The feedback can be used to control any output of the system, for example beam properties, sample position or flow in the chamber, treatment duration, and losses of energy at boundaries and in transit via reflection, dispersion, diffraction, absorption, dephasing and detuning.

The desired result of acoustic treatment, which may be achieved or enhanced by use of ultrasonic wavetrains, can be, without limitation, heating the sample, cooling the sample, fluidizing the sample, micronizing the sample, mixing the sample, stirring the sample, disrupting the sample, permeabilizing a component of the sample, forming a nanoemulsion or nano formulation, enhancing a reaction in the sample, solubilizing, sterilizing the sample, lysing, extracting, comminuting, catalyzing, and/or selectively degrading at least a portion of a sample. In embodiments specifically discussed herein, specialized mixing of the sample is particularly effective in enhancing ligation reactions. Sonic waves may also enhance filtration, fluid flow in conduits, and fluidization of suspensions. Processes in accordance with the present disclosure may be synthetic, analytic, or simply facilitative of other processes such as stirring.

While aspects of the invention have been described with reference to various illustrative embodiments, such aspects are not limited to the embodiments described. Thus, it is evident that many alternatives, modifications, and variations of the embodiments described will be apparent to those skilled in the art. Accordingly, embodiments as set forth herein are intended to be illustrative, not limiting. Various changes may be made without departing from the spirit of aspects of the invention.

The invention claimed is:

1. An apparatus comprising:

a well plate having a plurality of sample wells arranged in an array, each of the sample wells having an exterior surface protruding downwardly from an underside of the well plate; and a pad of absorbent material including a plurality of openings arranged in an opening array, the plurality of openings in the opening array being configured to receive the exterior surface of each of the plurality of sample wells protruding from the underside of the well plate in a corresponding one of the plurality of openings such that the exterior surface of the sample well is contacted by the pad at the corresponding one of the plurality of openings to remove liquid from the exterior surface of the sample well and absorb the liquid into the pad.

2. The apparatus of claim 1, wherein the plurality of openings of the pad are arranged to simultaneously receive the exterior surfaces of the plurality of sample wells into corresponding ones of the plurality of openings.

3. The apparatus of claim 2, wherein the plurality of openings of the pad are arranged to receive corresponding ones of the plurality of sample wells that are inserted downwardly into the plurality of openings.

4. The apparatus of claim 1, wherein the pad has a body with a planar top surface, and the plurality of openings each extend downwardly from the planar top surface into the pad body.

5. The apparatus of claim 4, wherein the pad body further includes a trough formed in the pad body and extending around the plurality of openings, the trough being configured to receive a skirt of the well plate that extends around the plurality of sample wells.

6. The apparatus of claim 1, wherein the plurality of openings each have a tapered shape such that an upper portion of each opening is larger than a lower portion of each opening.

7. The apparatus of claim 1, wherein the plurality of openings each have a conical shape that conforms to a conical shape of a corresponding sample well.

8. The apparatus of claim 1, wherein the plurality of openings are each arranged to receive an entire exterior surface of a corresponding sample well that protrudes downwardly from the underside of the well plate.

9. The apparatus of claim 1, further comprising a frame that extends around the pad and supports the pad such that the frame and pad are movable together by grasping and moving the frame.

10. The apparatus of claim 9, wherein the frame includes walls that extend around the pad and a floor that extends between the walls of the frame and supports a bottom surface of the pad.

11. The apparatus of claim 9, wherein the pad has a top surface into which the plurality of openings extend, and the top surface is recessed below an upper surface of the frame.

12. The apparatus of claim 11, wherein the frame is arranged and the top surface of the pad is recessed below the upper surface of the frame such that the frame and pad are invertable for placement of the upper surface of the frame on a flat support surface such that the pad is supported by the frame without the top surface contacting the flat support surface.

13. The apparatus of claim 1, wherein the pad has a top surface from which the plurality of openings extend into the pad, the apparatus further comprising an array of caps arranged on a side of the pad opposite the top surface, the array of caps being configured to be placed over an upper side of the well plate to cover the plurality of sample wells, each of the array of caps being configured to cover a corresponding one of the plurality of sample wells.

14. The apparatus of claim 13, wherein each of the plurality of caps includes a convex portion arranged to be partially received into a corresponding sample well to cover the sample well.

15. The apparatus of claim 13, further comprising a frame that extends around the pad and supports the pad and the plurality of caps such that the frame, pad and plurality of caps are movable together by grasping and moving the frame.

16. The apparatus of claim 15, wherein the frame includes walls that extend around the pad and a floor that extends between the walls of the frame and supports a bottom surface of the pad, and wherein the plurality of caps are arranged on a side of the floor opposite the pad.

17. The apparatus of claim 15, wherein the top surface is recessed below an upper surface of the frame, and wherein the plurality of caps are arranged in a plane that is recessed below a lower surface of the frame.

18. The apparatus of claim 17, wherein the frame is arranged and the top surface of the pad is recessed below the upper surface of the frame such that the frame and pad are invertable for placement of the upper surface of the frame on a flat support surface such that the pad is supported by the frame without the top surface contacting the flat support surface, and wherein the frame is arranged and the array of caps are recessed from the lower surface of the frame for placement of the frame on the flat support surface such that the array of caps are supported without contacting the flat support surface.

19. The apparatus of claim 13, wherein the plurality of caps are formed as part of a sheet in which each of the plurality of caps extends from the sheet.

20. The apparatus of claim 13, further comprising a cap support plate having a plurality of cap openings, wherein each of the plurality of caps is secured to the cap support plate at a corresponding one of the plurality of cap openings.

21. An apparatus comprising:

a well plate having a plurality of sample wells arranged in an array, each of the sample wells having an exterior surface protruding downwardly at an underside of the well plate;

a pad of absorbent material having a top surface and arranged to contact the exterior surface on the underside of the well plate to remove liquid from the exterior surface of the sample wells and absorb the liquid into the pad; and a frame that extends around the pad and supports the pad such that the frame and pad are movable together by grasping and moving the frame, wherein the frame includes walls that extend around the pad and a floor that extends between the walls of the frame and supports a bottom surface of the pad, and wherein the top surface of the pad is recessed below an upper surface of the frame.

22. The apparatus of claim 21, wherein the pad includes a plurality of openings that extend into the pad from the top surface, the plurality of openings arranged to receive the exterior surfaces of the plurality of sample wells into corresponding ones of the plurality of openings.

23. The apparatus of claim 22, wherein the pad has a body with a planar surface that defines the top surface of the pad, and the plurality of openings each extend downwardly from the top surface into the pad body.

24. The apparatus of claim 23, wherein the pad body further includes a trough formed in the pad body and extending around the plurality of openings, the trough being configured to receive a skirt of the well plate that extends around the plurality of sample wells.

25. The apparatus of claim 23, wherein the plurality of openings each have a cylindrical shape.

26. The apparatus of claim 21, further comprising an array of caps arranged on a side of the floor opposite the pad, the array of caps being configured to be placed over an upper side of the well plate to cover the plurality of sample wells.

27. The apparatus of claim 26, wherein the array of caps is arranged in a plane that is recessed below a lower surface of the frame.

28. An apparatus comprising:

a well plate having a plurality of sample wells arranged in an array, each of the sample wells having an exterior surface protruding downwardly at an underside of the well plate;

a pad of absorbent material having a top surface at a top side of the pad and arranged to contact the exterior surface on the underside of the well plate to remove liquid from the exterior surface of the sample wells and absorb the liquid into the pad; and an array of caps arranged below the pad opposite the top side of the pad, the array of caps being configured to be placed over an upper side of the well plate with each of the array of caps being configured to cover a corresponding one of the plurality of sample wells.

29. The apparatus of claim 28, further comprising a frame that extends around the pad and supports the pad and the array of caps such that the frame, pad and array of caps are movable together by grasping and moving the frame.

30. The apparatus of claim 29, wherein the frame includes walls that extend around the pad and a floor that extends between the walls of the frame and supports a bottom surface of the pad.

31. The apparatus of claim 30, wherein the top surface of the pad is recessed below an upper surface of the frame.

32. The apparatus of claim 30, wherein the array of caps is arranged in a plane that is recessed below a lower surface of the frame.

33. The apparatus of claim 28, wherein the pad includes a plurality of openings that extend into the pad from the top surface, the plurality of openings arranged to receive the exterior surfaces of the plurality of sample wells into corresponding ones of the plurality of openings.

34. The apparatus of claim 33, wherein the pad has a body with a planar surface that defines the top surface of the pad, and the plurality of openings each extend downwardly from the top surface into the pad body.

35. The apparatus of claim 34, wherein the pad body further includes a trough formed in the pad body and extending around the plurality of openings, the trough being configured to receive a skirt of the well plate that extends around the plurality of sample wells.

36. The apparatus of claim 34, wherein the plurality of openings each have a cylindrical shape.

* * * * *